US005467837A

United States Patent [19]

Miller et al.

[11] Patent Number: 5,467,837

[45] Date of Patent: Nov. 21, 1995

[54] ROTARY DRILL BIT HAVING AN INSERT WITH LEADING AND TRAILING RELIEF PORTIONS

[75] Inventors: Thomas R. Miller, Waynesburg; Daniel C. Sheirer, Bedford, both of Pa.

[73] Assignee: Kennametal Inc., Latrobe, Pa.

[21] Appl. No.: 421,283

[22] Filed: Apr. 13, 1995

Related U.S. Application Data

[63] Continuation of Ser. No. 115,381, Sep. 1, 1993, abandoned.

[51] Int. Cl.[6] ..... E21B 10/46

[52] U.S. Cl. ..... 175/420.1; 175/420.2

[58] Field of Search ..... 175/414, 415, 175/420.1, 420.2, 427

[56] References Cited

U.S. PATENT DOCUMENTS

| | | | |
|---|---|---|---|
| 882,128 | 3/1908 | Thomas | 175/394 |
| 1,977,845 | 10/1934 | Emmons | 76/108.2 |
| 2,598,459 | 3/1952 | Steffes | 175/420.1 |
| 3,049,033 | 8/1962 | Benjamin | 408/59 |
| 4,099,585 | 7/1978 | Emmerich | 175/320 |
| 4,190,128 | 2/1980 | Emmerich | 175/420.1 |
| 4,243,113 | 1/1981 | Kleine | 175/420.1 |
| 4,252,202 | 2/1981 | Purser, Sr. | 175/421 X |
| 4,527,643 | 7/1985 | Horton et al. | 175/420.2 |
| 4,527,931 | 7/1985 | Sarin | 407/113 |
| 4,627,503 | 12/1986 | Horton | 175/420.2 |
| 4,817,742 | 4/1989 | Whysong | 175/420.1 |
| 4,817,743 | 4/1989 | Greenfield et al. | 175/435 |
| 4,819,748 | 4/1989 | Truscott | 175/420.1 |
| 5,172,775 | 12/1992 | Sheirer et al. | 175/57 |
| 5,184,689 | 2/1993 | Sheirer et al. | 175/420.1 |
| 5,184,925 | 2/1993 | Woods et al. | 408/144 |
| 5,311,959 | 5/1994 | Adams | 175/420.1 |
| 5,375,672 | 12/1994 | Peay et al. | 175/420.1 |

FOREIGN PATENT DOCUMENTS

| | | | |
|---|---|---|---|
| 516813 | 9/1976 | U.S.S.R. . | |
| 1087649 | 4/1984 | U.S.S.R. | 175/421 |

OTHER PUBLICATIONS

Fairhurst, "The Design of Rotary Drilling Bits" (undated).

*Primary Examiner*—David J. Bagnell
*Attorney, Agent, or Firm*—John J. Prizzi

[57] ABSTRACT

A roof drill bit having a tool body with a cutting insert brazed thereto. The cutting insert has opposite leading and trailing face portions joined by a side surface which has a leading side relief portion adjacent the leading face portion and a trailing side relief portion adjacent the trailing face portion. The trailing side relief portion, which extends from the leading face portion a distance equal to between about one-third to two-thirds the thickness of the insert, has a greater relief angle that the leading side relief portion, which extends from the trailing face portion a distance equal to between about one-third to about two-thirds the thickness of the insert.

30 Claims, 7 Drawing Sheets

ROTARY DRILL BIT HAVING AN INSERT WITH LEADING AND TRAILING RELIEF PORTIONS

This is a continuation of application Ser. No. 08/115,381 filed on Sep. 1, 1995, now abandoned.

BACKGROUND OF THE INVENTION

The invention pertains to an excavating tool such as, for example, a rotary drill bit, including the cutting insert therefor, and a method of drilling using the rotary drill bit, wherein the bit is useful for drilling through various earth strata. More specifically, the invention pertains to a roof drill bit, including the cutting insert therefor, and a method for using the roof drill bit, wherein the bit is useful for drilling bore holes in an underground mine.

The expansion of an underground mine, such as for example, a coal mine, requires digging a tunnel. Initially, this tunnel has an unsupported roof. Because the roof is not supported, there is an increased chance for a mine cave which, of course, adds to the hazards of underground coal mining. Furthermore, an unsupported roof is susceptible to rock and debris falling from the roof. Falling rock and debris can injure workers as well as create hazardous clutter on the floor of the tunnel.

In order to support and stabilize the roof in an underground tunnel, bore holes are drilled in the roof, i.e., earth strata. The apparatus used to drill these holes comprises a drill with a long shaft, i.e., drill steel, attached to the drill. A roof bit is detachably mounted to the drill steel at the distal end thereof. The roof bit is then pressed against the roof, and the drilling apparatus operated so as to drill a bore hole in the roof. The bore holes extend between about two feet and about twenty feet into the roof depending upon the particular situation. The typical rate of rotation is between about 250 to about 600 rpm, and the typical thrust is between about 100 to about 10,000 pounds for a time sufficient to drill the desired hole in the earth strata.

These bore holes are filled with resin and roof bolts are fixed within the bore holes. Roof support members, such as roof panels, are them attached to the roof bolts. The end result is a roof which is supported, and hence, is of much greater stability than the unsupported roof. This reduces the hazards associated with underground mining. The roof bolting process is considered to be an essential underground mining activity.

Roof bolting accounts for the largest number of lost time injuries in underground mining. During the roof bolting process, the roof is unsupported so that it does not have optimum stability. Furthermore, the roof bolting process exerts stresses on the roof so as to further increase the safety hazards during the roof bolting process. Thus, a decrease in the overall time necessary to bore holes reduces the time it takes to complete the roof bolting process. This is desirable since it contributes to the overall speed, efficiency and safety of the roof bolting process.

On occasion in the past, the roof bit would "stick", i.e., become bound, in the bore hole. When this occurs, it is necessary to halt the drilling, and then exert forces, and possibly impacts, to the roof bit to extract it from the bore hole. Sticking of the roof bit in the bore hole consumes additional time to remove it from the bore hole, and thereby lengthens the time necessary to complete the overall roof bolting process. Furthermore there is a chance that the cutting insert can be broken in an attempt to remove the roof bit from the bore hole. It thus would be desirable to provide a roof bit that does not have the tendency to stick in the bore hole during the drilling of bore holes.

The typical cutting insert for a roof bit is made from a cemented tungsten carbide, which is comprised of cobalt and WC. The cemented tungsten carbide degrades upon continuous exposure to high temperatures. In a typical roof bolting operation, the cemented tungsten carbide insert is subjected to high temperatures during the drilling of the bore holes. Exposure to these high temperatures tends to increase the wear rate of the cutting edge of the cutting insert which results in a slow down of the drilling operation. Upon the degradation of the cutting edge of the cutting insert during the drilling, the roof bit must be removed and replaced with another roof bit. It would be therefore desirable to provide a roof bit wherein the cemented tungsten carbide cutting insert thereof is structured so that the heat generated during drilling is reduced from earlier levels, thereby reducing the tendency of the cutting edge of the cemented carbide cutting insert to degrade, and hence, became dull so as to slow down the drilling operation.

Roof bits have also used cutting inserts that typically include a cemented tungsten carbide backing with a layer of polycrystalline diamond thereon. The polycrystalline diamond is heat sensitive so that the tendency of a bit to not generate as much frictional heat as in the past would be a desirable feature for roof bits that use a cutting insert that includes a layer of polycrystalline diamond.

Upon the completion of drilling in a bore hole, the drilling apparatus is oftentimes spun backwards so as to remove the roof bit from the bore hole. On occasion, the cemented tungsten carbide insert will become chipped upon the backwards rotation of the roof bit. Chipping of the cemented tungsten carbide cutting insert will sometimes necessitate replacement of the roof bit. Thus, it would be desirable to provide a roof bit with a cemented tungsten carbide insert that is structured so as to reduce the tendency to chip when the roof bit is spun backwards.

In the manufacture of the roof bit, one of the more expensive components thereof is the cemented tungsten carbide insert. Thus, it would be desirable to provide an improved roof bit wherein the amount of cemented tungsten carbide necessary to manufacture the cutting insert thereof is less than in earlier roof bits.

SUMMARY OF THE INVENTION

It is an object of the invention to provide an improved roof bit with an improved cutting insert.

It is another object of the invention to provide an improved roof bit that does not stick in the bore hole.

It is another object of the invention to provide an improved roof bit that generates less frictional heat during drilling than earlier roof bits.

It is another object of the invention to provide an improved roof bit that, when spun backwards while in the bore hole, has a reduced tendency to chip than have earlier roof drill bits.

Finally, it is another object of the invention to provide an improved roof bit that requires less cemented tungsten carbide to make the cutting insert thereof than in previous roof bits.

In one form thereof, the invention is a roof drill bit that includes a tool body which has a cutting insert affixed thereto. The cutting insert has one face, an opposite face, and a side surface which joins the one face and the opposite face. The side surface portion has a leading side relief portion adjacent to the one face and a trailing side relief portion adjacent to the opposite face. The trailing side relief portion is relieved to a greater degree than said leading side relief portion. The leading side relief portion extends from the one face a distance of between about one-third to about two-thirds the thickness of the cutting insert. The trailing side relief portion extends from the opposite face a distance of between about one-third to about two-thirds the thickness of the cutting insert.

In another form thereof the invention is a cutting insert for a roof drill bit, wherein the insert comprises one face, an opposite face, and a side surface which joins the faces. The side surface portion has a leading side relief portion adjacent to the one face and a trailing side relief portion adjacent to the opposite face. The trailing side relief portion has a relief angle that is greater than the relief angle of the leading side relief portion.

The leading side relief portion extends from the one face a distance of between about one-third to about two-thirds the thickness of the cutting insert. The trailing side portion extends from the opposite face a distance of between about one-third to about two-thirds the thickness of the cutting insert.

In still another form, the invention is an excavating tool that comprises a tool body having a cutting insert affixed to the axially forward end thereof. The cutting insert has one face, an opposite face, and a pair of side surfaces that join the faces. Each of the side surface portions has a leading side relief portion and a trailing side relief portion wherein the trailing side relief portion has a relief angle greater than the relief angle of the leading side relief portion.

The leading side relief portion extends from the one face a distance of between about one-third to about two-thirds the thickness of the cutting insert and the trailing side portion extends from the opposite face a distance of between about one-third to about two-thirds the thickness of the cutting insert.

In another form thereof, the invention is a method of drilling a hole in earth strata comprising a first step of positioning a tool including a rotary drill bit having a cutting insert against the earth strata. The cutting insert has one face, an opposite face, and a pair of side surfaces which join the faces. Each one of the side surface portions has a leading side relief portion and a trailing side relief portion. The trailing side relief portion is relieved to a greater degree than the leading side relief portion. The leading side relief portion extends from the one face a distance of between about one-third to about two-thirds the thickness of the cutting insert. The trailing side portion extends from the opposite face a distance of between about one-third to about two-thirds the thickness of the cutting insert. The method then includes the step of rotating the rotary drill bit a speed between about 250 to 600 rpm and at a thrust of between about 100 to about 10,000 pounds for a time sufficient to drill the hole in the earth strata.

In still another form, the invention is a cutting insert for a rotary drill bit. The insert comprises one face, an opposite face, and a pair of side surfaces which join the faces. One side surface portion has a leading side relief portion adjacent to the one face and a trailing side relief portion adjacent to the opposite face. The trailing side relief portion has a relief angle that is greater than the relief angle of the leading side relief portion. The leading side relief portion extends from the one face a distance of between about one-third to about two-thirds the thickness of the cutting insert. The trailing side portion extends from the opposite face a distance of between about one-third to about two-thirds the thickness of the cutting insert. The other side surface portion is approximately perpendicular to the leading face portion.

BRIEF DESCRIPTION OF THE DRAWINGS

The following is a brief description of the drawings which form a part of this patent application.

DETAILED DESCRIPTION OF THE SPECIFIC EMBODIMENTS

Figure 1:
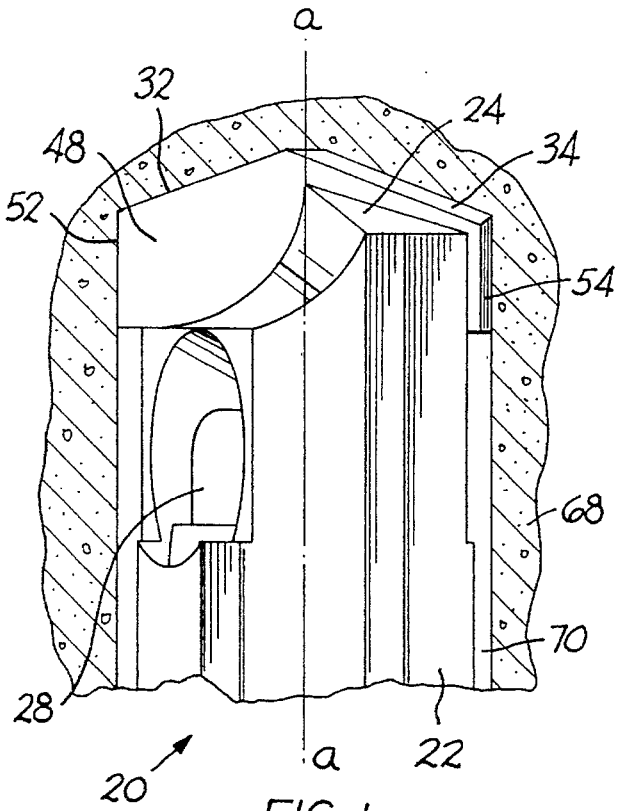
FIG. 1 is an isometric view of a first specific embodiment of the invention during a drilling operation in earth strata wherein the lower portion of the roof bit is removed, and a portion of the earth strata is cut away so as to show the relationship between the first specific embodiment and the earth strata.
Figure 2:
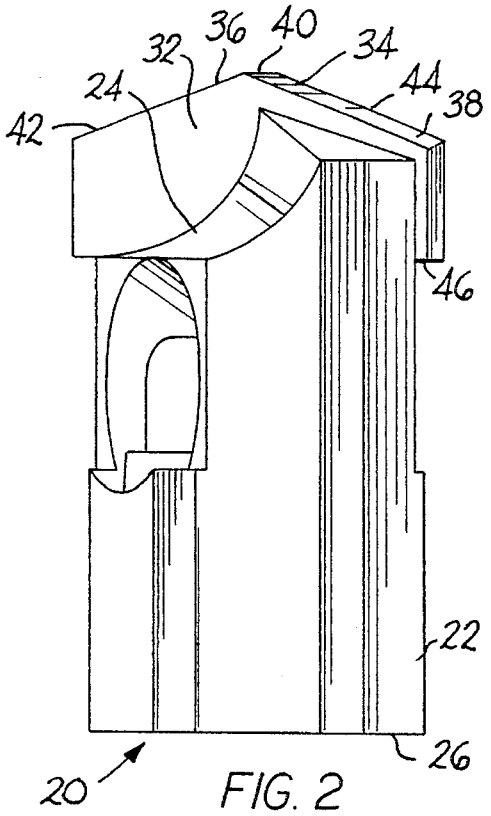
FIG. 2 is an isometric view of the first specific embodiment illustrated in FIG. 1.
Figure 4:
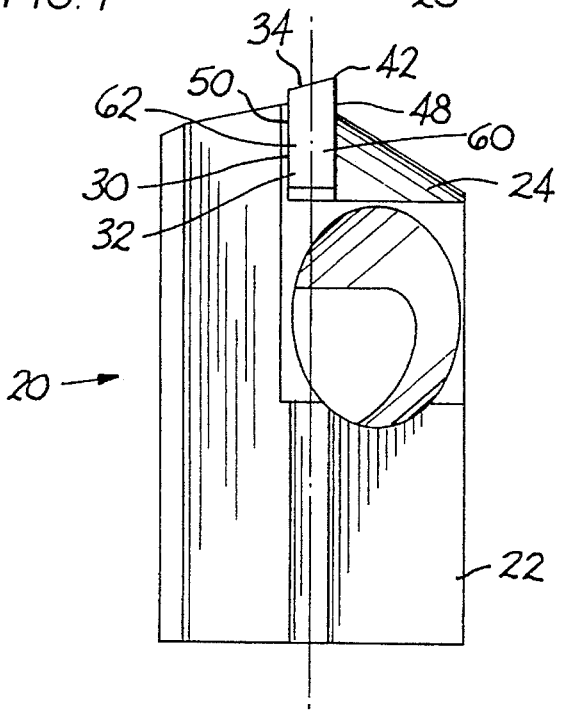
FIG. 4 is a side view of the first specific embodiment illustrated in FIG. 1.
Figure 3:
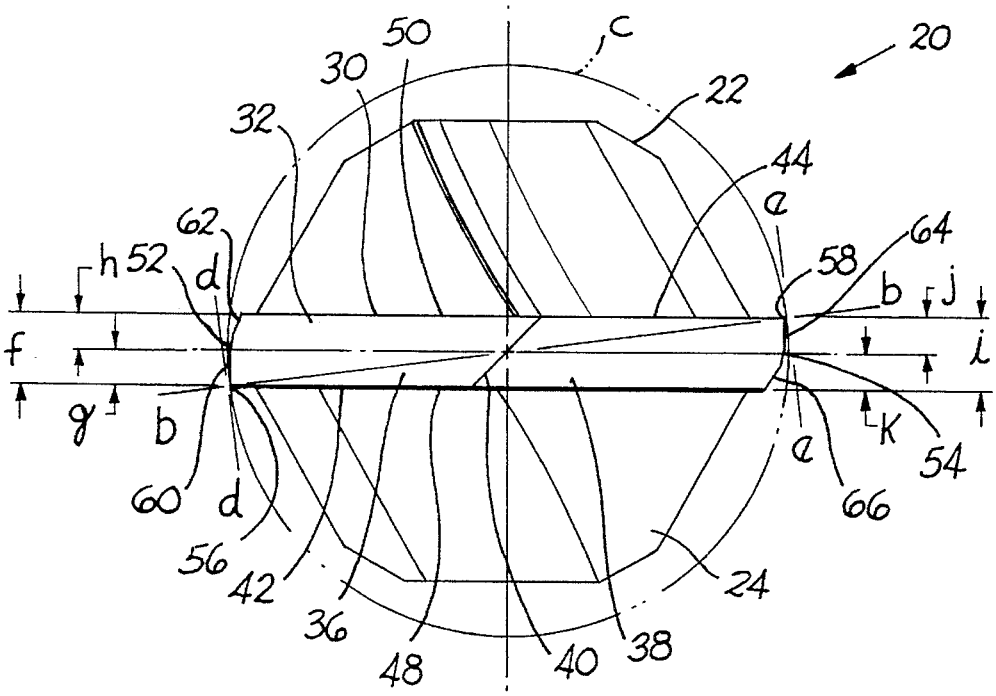
FIG. 3 is a top view of the first specific embodiment illustrated in FIG. 1.

Referring to the drawings, FIGS. 1 through 4 illustrate a first specific embodiment of the invention generally designated as roof bit 20. Roof Bit 20 includes an elongate steel body 22 with a central longitudinal axis a—a as illustrated in FIG. 1. Body 22 has an axially forward end 24 and an opposite axially rearward end 26 (as shown in FIG. 2). Elongate steel body 22 defines an interior volume 28 inside of the roof bit 20. As depicted in FIGS. 3 and 4, the forward end 24 of the steel body 22 contains a transverse slot 30. A cutting insert 32 is positioned within the slot 30. Cutting insert 32 is affixed within the slot 30 by brazing techniques that are known to those skilled in the art.

The cutting insert 32 is typically made from cemented tungsten carbide which is a mixture of cobalt and tungsten carbide. The cemented tungsten carbide preferably contains between about 5 to about 15 weight percent cobalt with the balance tungsten carbide. The grain size of the tungsten carbide may vary from fine, i.e., about 1 micron, which provides a harder insert, to coarse, i.e., about 18 microns, which provides a tougher insert. The preferred grade of cemented tungsten carbide varies with the particular application. The typical roof bit may use one of the following four grades: Grade No. 1 which has a WC grain size within a range of 1 to 18 microns, a nominal cobalt content of about 5.7 weight percent and a nominal hardness on the Rockwell "A" scale of 88.3; Grade No. 2 which has a WC grain size within a range of 1 to 9 microns, a nominal cobalt content of about 6.0 weight percent, and a nominal hardness on the Rockwell "A" scale of 90.4; Grade No. 3 which has a WC grain size within a range of 1 to 15 microns, a nominal cobalt content of about 5.6 weight percent, and a nominal hardness on the Rockwell "A" scale of 89.4; and Grade No. 4 which has a nominal cobalt content of 6.0 weight percent and a nominal hardness on the Rockwell "A" scale of 89.6. However, a polycrystalline diamond cutting insert may be used with the roof bit wherein such cutting insert has a cemented WC substrate with one or more polycrystalline diamond layers. One example of such a polycrystalline diamond insert is shown in pending U.S. patent application Ser. No. 07/935,956, to Sheirer et al., for a "Cutting Bit and Cutting Insert," filed on Aug. 26, 1992, and owned by the assignee of this patent application. This patent application is hereby incorporated by reference herein.

The preferred braze alloy is HI-TEMP 080 Braze alloy made by Handy & Harman of New York, N.Y. HI-TEMP 080 has the following composition: 54.6 wt. % Cu, 25 wt. % Zn, 8 wt. % Ni, 12 wt. % Mn, and 0.15 wt. % Si. This alloy has a melting temperature range of 1575° F. to 1675° F. It is also preferred that this braze alloy be used as a shim in conjunction with a perforated steel shim. U.S. Pat. No. 4,817,742, to Whysong, U.S. Pat. No. 4,817,743, to Greenfield et al., and U.S. Pat. No. 5,184,925, to Woods et al., all of which are owned by the assignee of the present patent application, show typical braze shim arrangements. These U.S. Pat. Nos. 4,817,742; 4,817,743; and 5,184,925 are hereby incorporated by reference herein.

Referring to the structure of cutting insert 32, cutting insert 32 includes a top surface 34 preferably having two inclined portions 36 and 38 meeting at an apex 40. The cutting insert 32 also has cutting edges 42 and 44 corresponding to each inclined portion 36 and 38, respectively. The top surface 34 can present any one of a number of configurations known to those skilled in the art. In this regard, U.S. Pat. No. 5,172,775, to Sheirer et al., and U.S. Pat. No. 5,184,689, to Sheirer et al., both of which are owned by the assignee of the present patent application, show alternate preferred configurations for the top surface of the cutting insert, and are hereby incorporated by reference herein. Cutting insert 32 further includes a bottom surface 46.

Cutting insert 32 presents a pair of opposite faces 48 and 50. A pair of opposite side surfaces 52 and 54 join together the opposite faces 48 and 50. Referring specifically to FIG. 3, the joinder of side surface 52 and face 48 is at corner 56. The joinder of side surface 54 and face 50 is at corner 58. As illustrated in FIG. 3, an imaginary diagonal line b—b extends between corner 56 and corner 58 of cutting insert 32. Rotation of the roof bit 20 about its central longitudinal axis a—a causes corners 56 and 58 of the cutting insert 32 to circumscribe out a circular envelope designated "c" in FIG. 3. Line b—b is the diameter of the circular envelope c. Line d—d is a tangent to circular configuration c at corner 56. Line e—e is a tangent to circular configuration c at corner 58.

Side surface 52 presents a leading side relief surface 60 and a trailing side relief surface 62. Side surface 54 presents a leading side relief surface 64 and a trailing side relief surface 66. In the specific embodiment of FIGS. 1–4, the thickness of the leading and trailing side relief surfaces for each side surface 52, 54 are equal. Referring to FIG. 3, the thickness of side surface 52 is equal to "f", and the thickness "g" of the leading side relief surface 60 and the thickness "h" of the trailing side relief surface 62 are each equal to one-half the value of "f". The thickness of side surface 54 is equal to "i", and the thickness "j" of the leading side relief surface 64 and the thickness "k" of the trailing side relief surface 66 are each equal to one-half the value of "i".

Figure 3A:
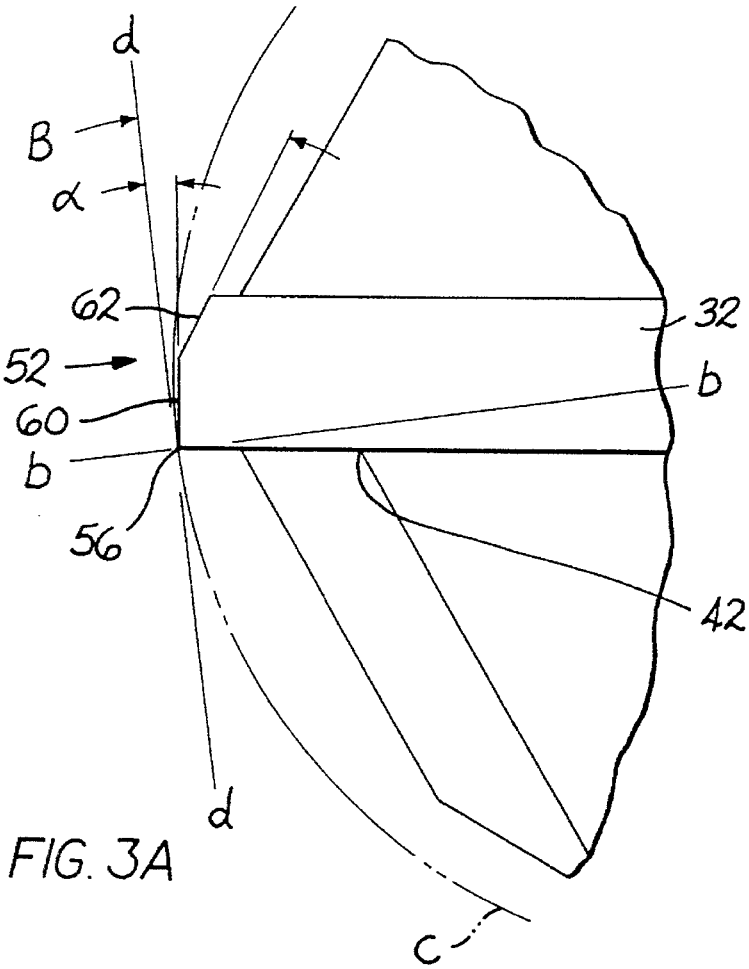
FIG. 3A is an enlarged top view of a portion of the first specific embodiment illustrated in FIG. 1.

Referring to FIG. 3A, there is illustrated an enlargement of the side surface 52 showing the orientation of the leading side relief surface 60 and trailing side relief surface 62 to the tangent line d—d. Leading side relief surface 60 is positioned at angle "α" from tangent line d—d. Angle α is 5° in this specific embodiment; however, the scope of the invention contemplates that angle α could be between one range of about 0° and about 8° and within a narrower range of about 2° to about 6°. Trailing side surface 62 is positioned at angle "β" from tangent line d—d. Angle β is 22° in this specific embodiment; however, the scope of the invention contemplates that angle β could be between one range of about 10° and about 30° and within a narrower range of about 14° to about 26°. Although not illustrated in an enlarged view, the relative orientation of the leading side relief surface 64 and trailing side relief surface 66 of side surface 54 is the same with respect to tangent line e—e.

Referring to FIG. 1, in this drawing the roof bit 20 is illustrated in a drilling application of earth strata 68 so as to create a bore hole 70 in the earth strata 68. In order to provide rotary motion to the roof bit 20, a drill steel (not illustrated) is received within the volume inside the roof bit in a conventional fashion known to those skilled in the art. The drill steel is connected to a drilling apparatus (not illustrated), which is also known to those skilled in the art. The drilling apparatus provides both rotary motion and thrust to the roof bit during a drilling operation. The typical rotary speed ranges between 250 and 600 rpm. The typical thrust is between 100 and 10,000 pounds. Because the connection between the roof bit and the drill steel and the operation of the drilling apparatus are well known to those skilled in the art, no further description thereof is necessary herein.

In operation, roof bit 20 provides a rotary drilling bit that does not "stick" in the bore hole during drilling. This is due to the fact that the side surfaces of the cutting insert 32 present trailing side relief surfaces (62, 66) that are relieved at an angle β greater than the relief angle α of the leading side relief surfaces (60, 64), which thereby places less carbide in surface contact with the side of the bore hole 70. By reducing this contact area, the tendency to "stick" or bind in the bore hole 70 is reduced over earlier roof bits having side surfaces with a constant 5 degree relief angle.

Due to the fact that there is less surface contact between the side surface of the cutting insert and wall of the bore hole 70, there is less frictional heat generated during drilling. Consequently, there is less heat to degrade the cutting edge of the cemented tungsten carbide cutting insert 32. This then results in less of a tendency for the cutting edge (42, 44) to become dull due to heat degradation. The end result is a longer life for the cutting insert.

Each trailing side relief surface (62, 66) presents a relief angle β that is greater than the relief angle α of its corresponding leading side relief surface (60, 64). The termination of each trailing side relief surface (62, 66) and its adjacent face is at a corner that is relieved from the wall of the bore hole to a greater extent than with earlier roof bits thereby making it stronger. Therefore, upon rotating the roof bit in reverse to withdraw the bit from the hole, which is a common occurrence, there is no shoulder or other part of the insert to "catch" or impinge on the wall so that there is a less chance of the cutting insert becoming chipped or broken at this corner than with earlier cutting inserts.

It can be appreciated that the cutting insert 32 of the present invention requires less of a volume of cemented tungsten carbide to make than earlier cutting inserts having a side surface with constant relief angle of 5 degrees. Thus, the present invention also provides for reducing the cost of the roof bit by reducing the volume of cemented tungsten carbide, an expensive component, required for the roof bit 20.

Figure 6:
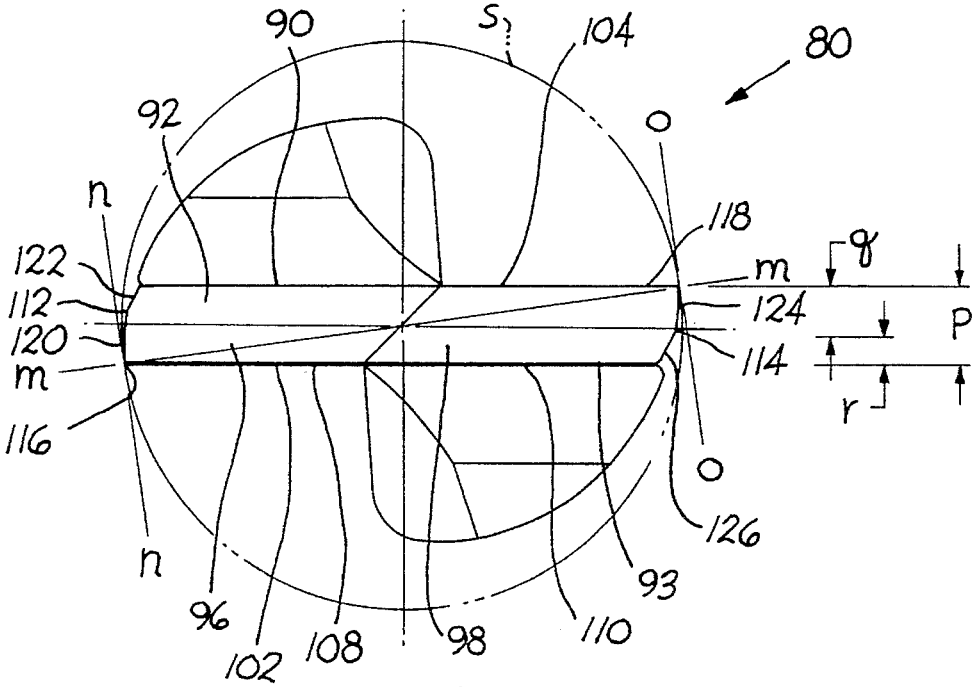
FIG. 6 is a top view of the second specific embodiment of FIG. 5.
Figure 5:
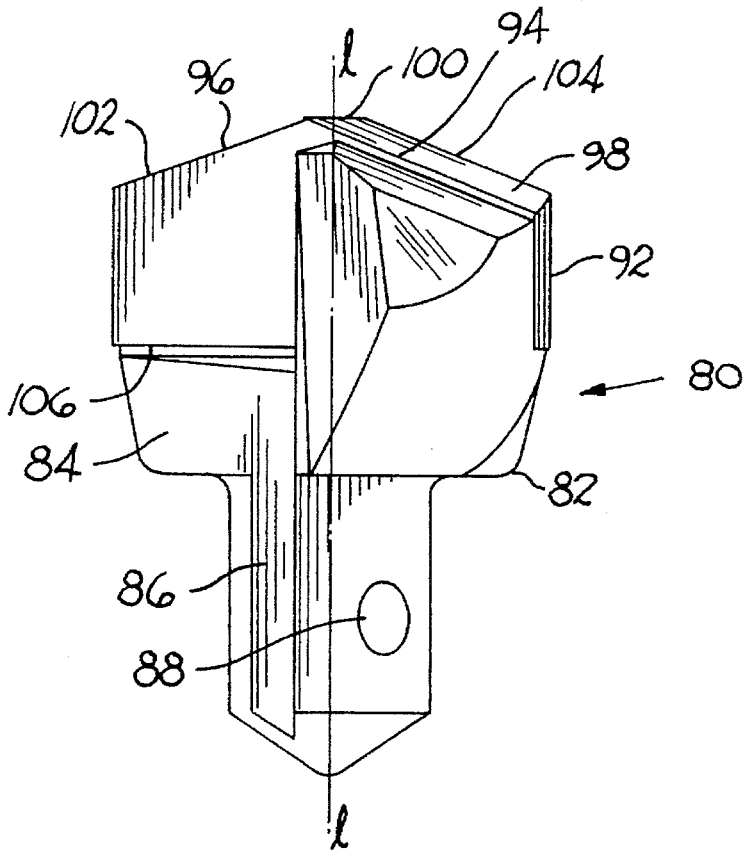
FIG. 5 is an isometric view of a second specific embodiment of the invention.
Figure 7:
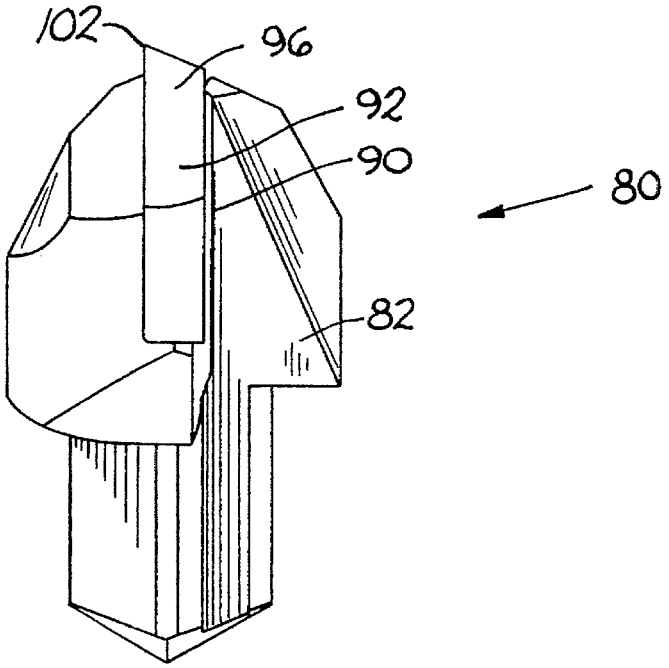
FIG. 7 is a side view of the second specific embodiment of FIG. 5.

Referring to FIGS. 5 through 7, there is illustrated a second specific embodiment of the invention, generally designated as roof bit 80. Roof bit 80 includes a steel body 82 that has a central longitudinal axis l—l as shown in FIG. 5. Body 82 has an axially forward head 84 and an axially rearward shank 86. Shank 86 contains a hole 88 therethrough. The forward head 84 of the steel body 82 has a transverse slot 90 contained therein. A cemented tungsten carbide cutting insert 92 is brazed within the transverse slot 90 via known brazing techniques.

In order to provide rotary motion to the roof bit 80, a hollow drill steel (not illustrated) receives the shank 86 of the roof bit within the volume thereof in a conventional fashion known to those skilled in the art. The drill steel is connected to a drilling apparatus (not illustrated), which is also known to those skilled in the art. The drilling apparatus provides both rotary motion and thrust to the drill bit during a drilling operation. The typical speeds and thrusts have been previously identified and will not be repeated herein. Because the connection between the drill bit and the drill steel and the operation of the drilling apparatus are well known to those skilled in the art, no further description thereof is necessary herein.

Referring now to the structure of cutting insert 92, cutting insert 92 includes a top surface 94 opposite inclined portions 96 and 98 which meet at an apex 100. Each inclined surface portion 96 and 98 presents a cutting edge 102 and 104, respectively. The top surface 94 may present any one of a number of configurations known to those skilled in the art such as described in U.S. Pat. Nos. 5,172,775 and 5,184,689 which have been previously incorporated by reference herein. Cutting insert 92 further has a bottom surface 106. Cutting insert 92 further includes opposite faces 108 and 110.

A pair of opposite side surface 112 and 114, along with the top surface 94 and bottom surface 106, join together the opposite faces 108 and 110. Referring specifically to FIG. 6, the joinder of side surface 112 and face 108 is at corner 116. The joinder of side surface 114 and face 110 is at corner 118. As illustrated in FIG. 6, an imaginary diagonal line m—m extends between corner 116 and corner 118 of cutting insert 92. Rotation of the roof bit 80 about its central longitudinal axis l—l causes corners 116 and 118 of the cutting insert 92 to circumscribe out a circular envelope designated "s" in FIG. 6. Line n—n is a tangent to circular configuration s at corner 116. Line o—o is a tangent to circular configuration s at corner 118.

Side surface 112 presents a leading side relief surface 120 and a trailing side relief surface 122. Side surface 114 presents a leading side relief surface 124 and a trailing side relief surface 126. In the specific embodiment of FIGS. 5–7, the thickness of the leading side relief surfaces (120, 124) is about twice the thickness of the trailing side relief surfaces (122, 126). Referring to side surface 114 as shown in FIG. 6, the leading side relief surface 124 is of a thickness "q" which is equal to about two-thirds the total thickness "p" of the cutting insert 92. The trailing side relief surface 126 is of a thickness "r" which is equal to about one-third the total thickness "p" of the cutting insert 92.

In regard to the thickness of side surface 112, the leading side relief surface 120 and trailing side relief surface 122 are of the same dimension as their corresponding leading and trailing side relief surfaces (124, 126) of side surface 114. In other words, the thickness of leading side relief surface 120 is equal to about two-thirds the thickness of the insert. Trailing side relief surface 122 has a thickness equal to about one-third the thickness of the cutting insert 92.

Figure 6A:
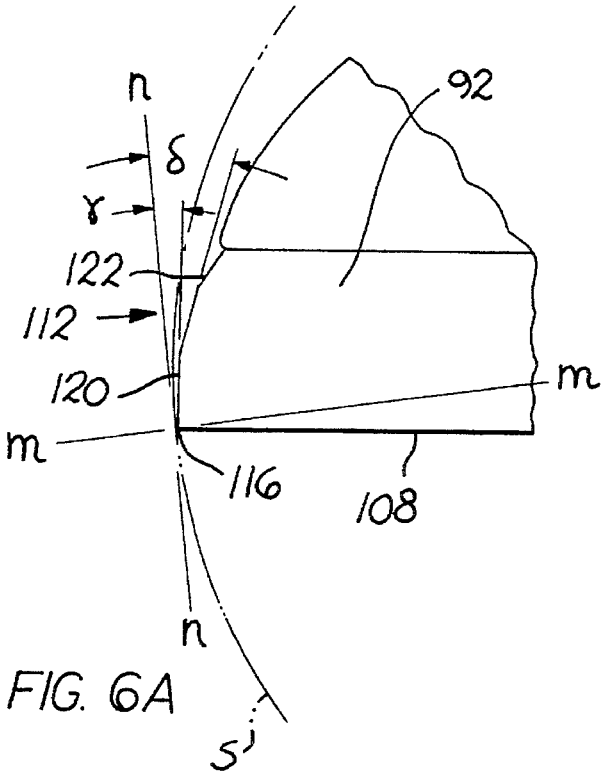
FIG. 6A is an enlarged top view of a portion of the second specific embodiment illustrated in FIG. 5.

Referring to FIG. 6A, there is illustrated an enlargement of the side surface 112 showing the orientation of the leading side relief surface 120 and trailing side relief surface 122 to the tangent line n—n. Leading side relief surface 120 is positioned at angle "γ" from tangent line n—n. Angle γ is 5° in this specific embodiment; however, the scope of the invention contemplates that angle γ could be between one range of about 0° and about 8° or within a narrower range of between about 2° to about 6°.

Trailing side relief surface 122 is positioned at angle "δ" from tangent line n—n. Angle δ is 22° in this specific embodiment; however, the scope of the invention contemplates that angle δ could be between one range of about 10° and about 30° or within a narrower range of between about 14° to about 26° . Although not illustrated in an enlarged view, the relative orientation of the leading side relief surface 124 and trailing side relief surface 126 of side surface 114 is the same with respect to tangent line o—o as the leading and trailing side relief surfaces (120, 122) are with respect to line n—n.

Because the shape of cutting insert 92 is essentially the same as that of cutting insert 32, a description of the operation and advantages of the roof bit 80 is not necessary. The earlier description pertaining to roof bit 20 is sufficient for this specific embodiment.

Figure 8:
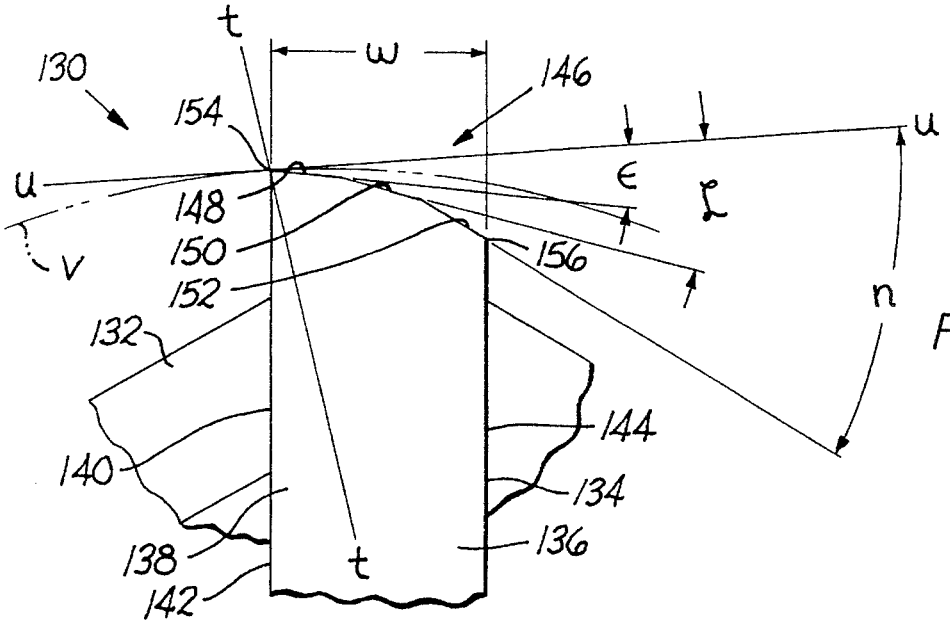
FIG. 8 is a top view of a third specific embodiment of the invention with a portion of the roof bit cut away.

Referring to FIG. 8, there is illustrated a partial top view of a third specific embodiment of the roof bit 130. The overall structure of the roof bit 130 is like that of roof bit 20, except for the structure of the side surfaces of the cutting insert. Roof bit 130 includes a steel body 132 having a transverse slot 134 contained therein. A cutting insert 136 is brazed within slot 134 through known brazing techniques. The structure of cutting insert 136 is similar to that of cutting insert 32, except for the structure of the side surfaces, which become apparent from the description below.

Cutting insert 136 includes a top surface 138 that has a cutting edge 140. Cutting insert 136 also has opposite faces 142 and 144 joined by a pair of side surfaces; however, in FIG. 8, only one side surface 146 is illustrated. It should be understood that the description of the one side surface 146 will suffice for the description of the other side surface. One side surface 146 includes a leading side relief surface 148, a mediate side relief surface 150 and a trailing side relief surface 152. Although three side relief surfaces are illustrated in FIG. 8, one should understand that the invention is presently intended to encompass a side relief surface having a plurality of discrete portions.

A diagonal imaginary line t—t extends from the corner 154 where the one face 142 joins the leading side relief surface 146 to the corner (not illustrated) where the other face 144 joins the leading side relief surface of the other side surface (not illustrated). A line u—u is tangent to the circular envelope "v" circumscribed by the corner 154 of the cutting insert 136 upon the rotation of the roof bit 130.

The leading side relief surface 148 is disposed at an angle "ϵ" from tangent line u—u. The mediate side relief surface 150 is disposed at an angle "ζ" from tangent line u—u. The trailing side relief surface 152 is disposed at an angle "η" from tangent line u—u. As one can see by FIG. 8, the angle of relief increases as one moves from the leading to the mediate to the trailing side relief surface. In the specific embodiment, angle "ϵ" for the leading side relief surface 148 is about 5°, angle "ζ" for the mediate side relief surface 150 is about 14°, and angle "η" for the trailing side relief surface 152 is about 22°. The present scope of the invention contemplates that angle "ζ" has a range of between about 0° and about 8°, angle "ζ" has a range of between about 8° and about 15°, and angle "η" has a range of between about 15° and about 30°. As an alternative description of the orientation of the leading side relief portion 148, the leading side relief angle is of such a magnitude so that the interior angle between the one face 142 and the leading side relief portion 148 is less than 90 degrees. The invention contemplates narrower ranges for the angles wherein ϵ is between 2° and 6°, ζ is between 10° and 15°, and η is between 18° and 26°. The magnitude of each relief angle is dependent upon the specific application for the bit.

In the specific embodiment of FIG. 8, the thickness of each one of the leading, mediate and trailing side relief surfaces (148, 150, 152) equals about one-third of the thickness "w" of the cutting insert 136. The present scope of the invention contemplates that the thickness of each one of the leading, mediate and trailing side relief surfaces could between about one-fourth to about four-tenths of the thickness of the cutting insert 136. The particular thickness of each side relief surface is dependent upon the particular application for the roof bit.

In operation, roof bit 130 provides a rotary drilling bit that does not "stick" in the bore hole during drilling. This is due to the fact that the side surfaces of the cutting insert 136 present a mediate side relief surface 150 and a trailing side relief surface 152 that are each relieved at an angle greater than the relief angle of the leading side relief surface 148, which thereby places less carbide surface in contact with the wall of the bore hole. By reducing the contact area, the tendency to "stick" or bind in the bore hole is reduced over earlier roof bits having side surfaces with a constant 5 degree relief angle.

Due to the fact that there is less surface contact between the side surface of the cutting insert 136 and wall of the bore hole, there is less frictionally generated heat during drilling. Consequently, there is less heat to degrade the cutting edge of the cemented tungsten carbide cutting insert rendering it dull and slowing down the drilling operation. A reduction in the thermal degradation of the cutting edge leads to a longer life for the cutting insert.

The trailing side relief surface 152 presents a relief angle that is greater than the relief angle of the leading side relief surface 148 or the relief angle of the mediate side relief surface 150. The termination of the trailing side relief surface 152 and the trailing face portion is at a corner 156 that is relieved from the wall of the bore hole to a greater extent than with earlier roof bits. Therefore, upon reversing the roof bit to remove it from the bore hole, which is a common occurrence, there is a less chance of the cutting insert catching or impinging upon the wall of the bore hole and thereby being chipped or broken at this corner than with earlier cutting inserts.

It can be appreciated that the cutting insert 136 of the present invention requires less of a volume of cemented tungsten carbide to make than earlier cutting inserts having a side surface with relief angle of 5 degrees. Thus, the present invention also provides for reducing the cost of the roof bit 130 by reducing the volume of cemented tungsten carbide, the most expensive component, required for the roof bit.

Figure 9:
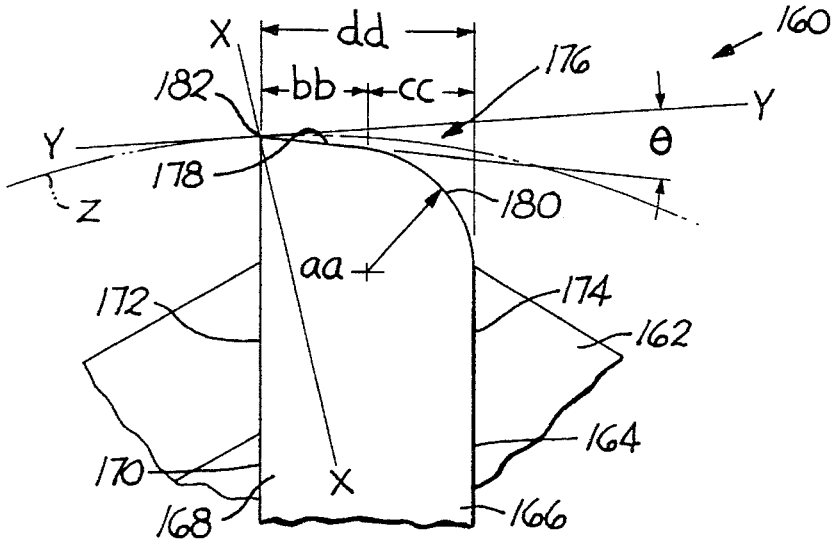
FIG. 9 is a top view of a fourth specific embodiment of the invention with a portion of the roof bit cut away.

Referring to FIG. 9, there is illustrated a partial top view of a fourth specific embodiment of the roof bit 160. The overall structure of the roof bit is like that of roof bit 20, except for the structure of the side surfaces of the cutting insert. Roof bit 160 includes a steel body 162 having a slot 164 contained therein. A cutting insert 166 is positioned within slot 164 by brazing techniques known to those skilled in the art. The preferred braze alloy and grades of cemented tungsten carbide have been previously identified so that further description thereof is not necessary.

Cutting insert 166 has a top surface 168 that presents a cutting edge 170. Cutting insert 166 has opposite faces 172 and 174 wherein side surfaces help to join the faces 172, 174. Only one side surface 176 is illustrated in FIG. 9; however, the other side surface is essentially the same as one side surface 176.

One side surface 176 includes leading side relief surface 178 and a convex side relief surface 180. The one face 172 joins the side surface 178 at a corner 182. An imaginary diagonal line x—x extends from the corner 182 to the opposite corner (not illustrated) wherein the other face 174 joins the other side surface. A tangent line y—y is tangent to the circular envelope z circumscribed by corner 182 upon the rotation of the roof bit 160. Leading side relief surface 178 is disposed from tangent line y—y at an angle "θ". In the specific embodiment θ equals 5°, but can be within the one range of 0° to about 8° and a narrower range of about 2° to about 6°. Convex side relief surface 180 is defined by a radius "aa". The thickness of the leading side relief surface 178 is equal to "bb". The thickness of the convex side relief surface 180 is "cc". The thickness of the entire cutting insert 166 is "dd".

In the specific embodiment of FIG. 9, the thickness "bb" of the leading side relief surface 178 is equal to the thickness "cc" of the convex side relief surface 180. Radius aa is equal to thickness cc of the convex relief surface 180. The scope of the invention encompasses a leading side relief surface 178 that has a thickness between about one-third to about two-thirds of the thickness "dd" of the cutting insert 166. The scope of the invention encompasses a convex relief surface 180 that has a thickness between about one-third to about two-thirds of the thickness "dd" of the cutting insert 166. The magnitude of the radius aa can be varied depending upon the thickness of the side relief surfaces and the desired extent of relief for the convex side relief surface 180.

In operation, roof bit 160 provides a rotary drilling bit that does not "stick" in the bore hole during drilling. This is due to the fact that the side surfaces of the cutting insert 166 present a convex side relief surface that is relieved to a greater degree than the relief angle of the leading side relief surface, which thereby places less carbide surface in contact with the side of the bore hole. By reducing the contact area, the tendency to "stick" or bind in the bore hole is reduced over earlier roof bits having side surfaces with a constant 5 degree relief angle.

Due to the fact that there is less surface contact between the side surface of the cutting insert and wall of the bore hole, there is less fictionally generated heat during drilling. Consequently, there is less heat to degrade the cutting edge of the cutting insert. A reduction in the tendency to dull the cutting edge results in a longer life for the cutting insert.

The convex side relief surface 180 is relieved to a greater extent than the relief angle θ of the leading side relief surface 178. While the termination of the convex side relief surface and the trailing face portion is at a corner, that corner is relieved from the wall of the bore hole to a greater extent than with earlier roof bits. Therefore, upon reversing the roof to remove it from the bore hole, which is a common occurrence, there is a less chance of the cutting insert catching or impinging on the wall of the bore hole thereby becoming chipped or broken at this corner than with earlier cutting inserts.

It can be appreciated that the cutting insert 166 of the present invention requires less of a volume of cemented tungsten carbide to make than earlier cutting inserts having a side surface with relief angle of 5 degrees. Thus, the present invention also provides for reducing the cost of the roof bit by reducing the volume of cemented tungsten carbide, the most expensive component, required for the roof bit.

Figure 10:
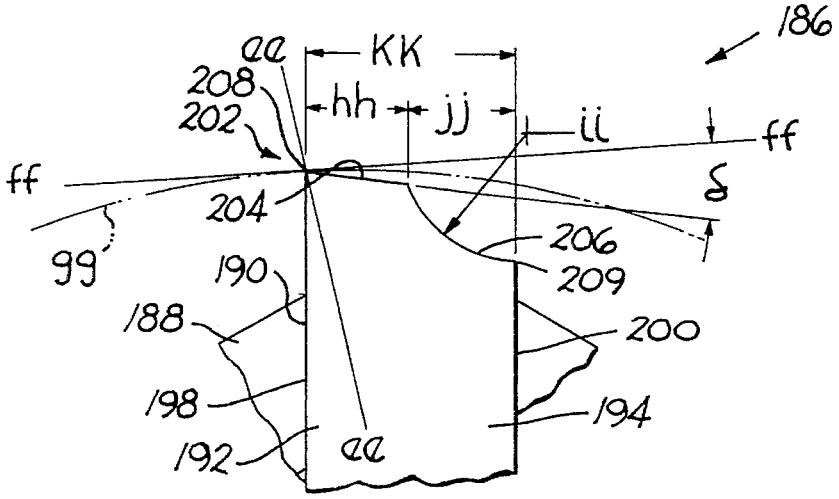
FIG. 10 is a top view of a fifth specific embodiment of the invention with a portion of the roof bit body cut away.

Referring now to FIG. 10, there illustrated a partial top view of a fifth specific embodiment of the roof bit 186. The overall structure of the roof bit 186 is like that of roof bit 20, except for the structure of the side surfaces of the cutting insert. Roof bit 186 includes a steel body 188 which contains transverse slot 190 therein. A cutting insert 192 is brazed within the transverse slot 190 in a fashion known to those skilled in the art. Preferred grades of cemented WC and braze alloy have been identified above.

Cutting insert 192 includes opposite faces 198 and 200 that are joined together, in part by a pair of side surfaces. FIG. 10 illustrates only side surface 202, but the other side surface is essentially the same as side surface 202. Side surface 202 includes a leading side relief surface 204 and a concave side relief surface 206. The one face 198 joins the one side surface 202 at a corner 208. An imaginary diagonal line ee—ee extends from the corner 208 to the opposite corner (not illustrated) wherein the other face 200 joins the other side surface. A tangent line ff—ff is tangent at corner 208 to the circular envelope gg circumscribed by corner 208 upon the rotation of the roof bit 186.

The leading side relief surface 204 is disposed from tangent line ff—ff at a relief angle "δ" and is of a thickness "hh". The specific relief angle "δ" is about 5 degrees. The invention is of a scope so as to encompass a relief angle "δ" between one range of about 0 degrees and about 8 degrees. The invention contemplates a narrower range for angle "δ" of between about 2° and about 6°. Concave side relief surface 206 is defined by a radius "ii" and is of a thickness "jj". The overall thickness of the cutting insert 186 is "kk".

In the specific embodiment of FIG. 10, the thickness "hh" of the leading side relief surface 204 is equal to the thickness "jj" of the concave side relief surface 206. The scope of the invention encompasses a leading side relief surface 204 that has a thickness between about one-third to about two-thirds of the thickness "kk" of the cutting insert 192. The scope of the invention encompasses a concave relief surface 206 that has a thickness between about one-third to about two-thirds of the thickness "kk" of the cutting insert 192.

In operation, roof bit 186 provides a rotary drilling bit that does not "stick" in the bore hole during drilling. This is due to the fact that the side surfaces of the cutting insert 192 present a concave side relief surface that is relieved to a greater degree than the relief angle of the leading side relief surface, which thereby places less carbide surface in contact with the side of the bore hole. By reducing the contact area, the tendency to "stick" or bind in the bore hole is reduced over earlier roof bits having side surfaces with a constant 5 degree relief angle.

Due to the fact that there is less surface contact between the side surface of the cutting insert 192 and wall of the bore hole, there is less frictionally generated heat during drilling. Consequently, there is less heat to degrade the cutting edge of the cemented tungsten carbide cutting insert. A reduction in the thermal degradation of the cutting edge lessens the dulling of the cutting edge which slows the drilling operation. The overall result is an increase in the life of the roof bit.

The concave side relief surface 206 is relieved to a greater extent than the relief angle of the leading side relief surface 204. While the termination of the convex side relief surface 206 and the trailing face portion is at a corner 209, that corner 209 is relieved from the wall of the bore hole to a greater extent than with earlier roof bits. Therefore, upon reversing the roof bit to remove it from the bore hole, which is a common occurrence, there is a less chance of the cutting insert catching or impinging on the wall of the bore hole thereby becoming chipped or broken at this corner than with earlier cutting inserts.

Figure 11:
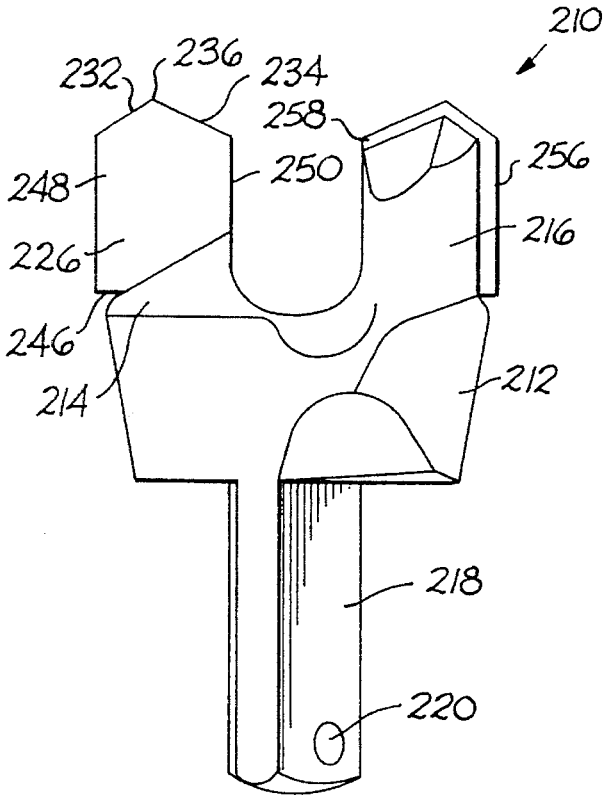
FIG. 11 is an isometric view of a two-prong drill which is a sixth specific embodiment of the invention.
Figure 12:
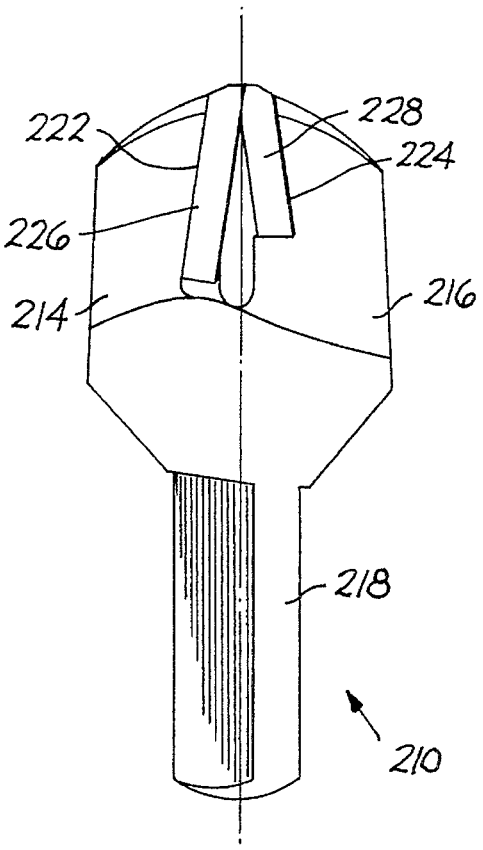
FIG. 12 is a side view of the sixth specific embodiment of FIG. 11.
Figure 13:
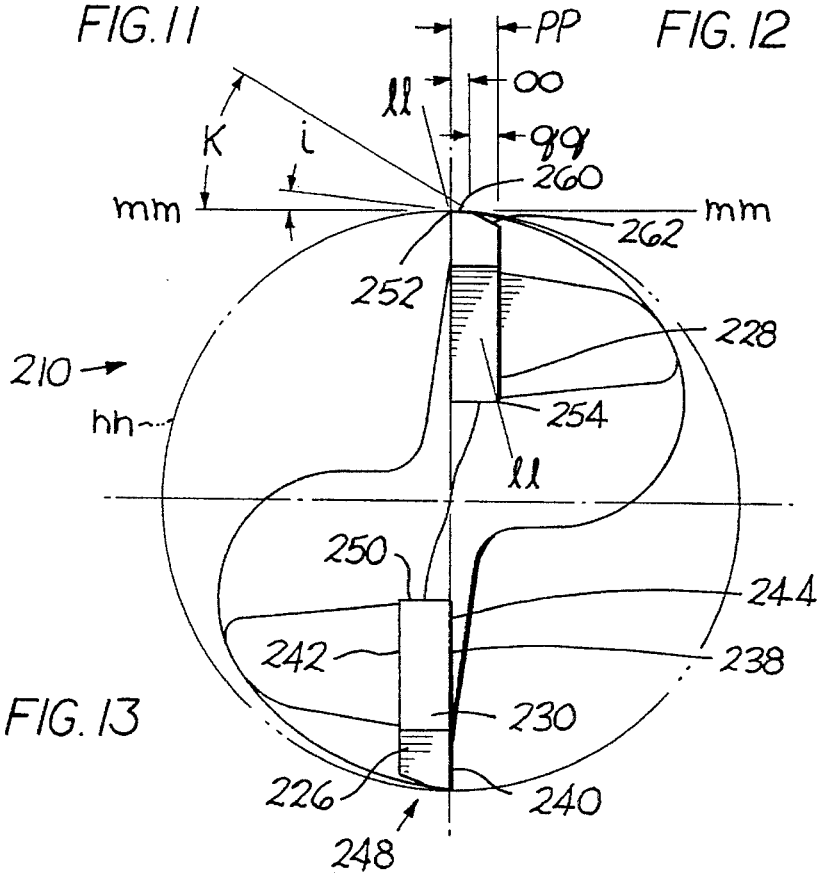
FIG. 13 is a top view of the sixth specific embodiment of FIG. 11.

Referring to FIGS. 11–13, a sixth specific embodiment of the invention is shown herein as a two-prong bit generally designated as 210. Bit 210 has a head 212 with two axially forwardly extending prongs 214 and 216. A shank 218 extends axially rearwardly from the head 212. Shank 218 contains a hole 220 therein. Each prong 214 and 216 contains a recess 222 and 224, respectively, therein that receives a cutting insert 226 and 228. Each cutting insert 226, 228 is identical in structure that a description of one will suffice for that of the other.

Cutting insert 226 has a top surface 230 with two inclined portions 232, 234 that meet at an apex 236. Cutting insert 226 also presents a cutting edge 240. Cutting insert 226 has opposite faces 242 and 244, which are joined together by the top surface 230, a bottom surface 246, and a pair of side surfaces 248 and 250.

Referring now to the cutting insert 228, an imaginary diagonal line ll—ll extends from one corner 252 of the cutting insert 228 to the diagonally opposite corner 254. A line mm—mm is tangent to the circular envelope "nn" circumscribed by the corner 252 upon the rotation of the bit 210. Cutting insert 228 has opposite side surfaces 256 and 258.

Side surface 256 has a leading side relief Surface 260 which is disposed at a relief angle "ι" from tangent line mm—mm equal to about 5°. Relief angle "ι" can range between one range of about 0° to about 8° or be within a narrower range of about 2° to about 6°. Side surface 256 also has a trailing side relief surface 262 which is disposed at a relief angle "κ" of about 22° from tangent line mm—mm. Relief angle "κ" can be within one range of between about 10° and about 30° or be within a narrower range of about 14° to about 26°. The thickness of the leading side relief surface 260 is "oo" and can vary between one-third to two-thirds the thickness "pp" of the cutting insert 228. The thickness of the trailing side relief surface 262 is "qq" and can vary between about one-third to two-thirds the thickness of the cutting insert 228. Side surface 244 is generally perpendicular to the one face 236 of the cutting insert 222.

In operation, the cutting inserts 222 and 224 provide advantages like those described for cutting the inserts of the first and second embodiments. Thus, the operation and the advantages of the cutting inserts will not be repeated herein.

Figure 14:
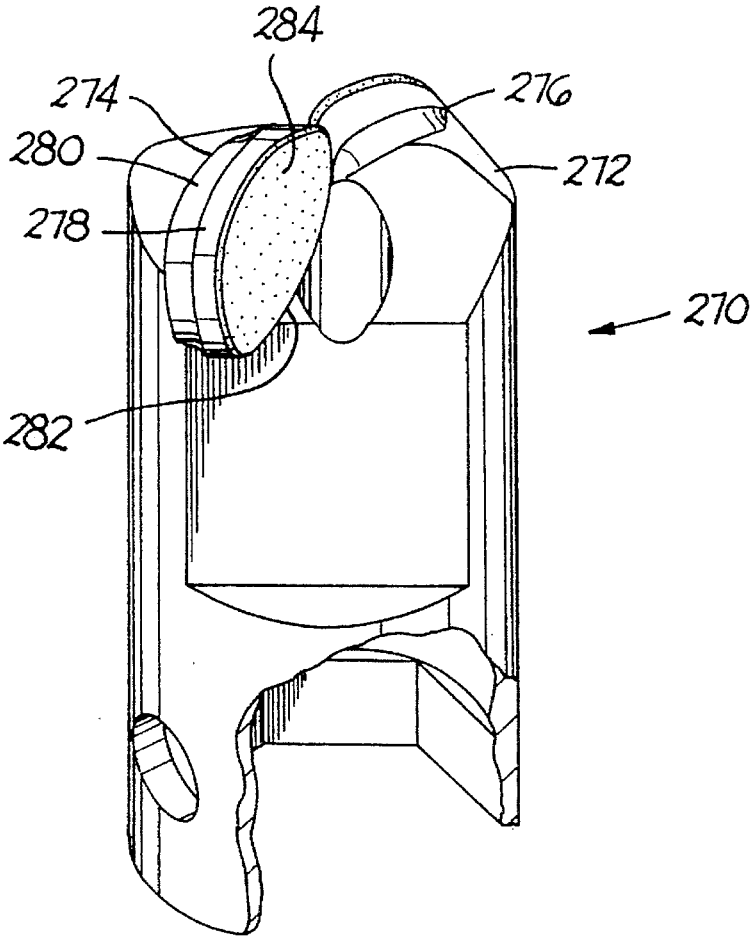
FIG. 14 is a perspective view of a seventh specific embodiment of the invention.
Figure 15:
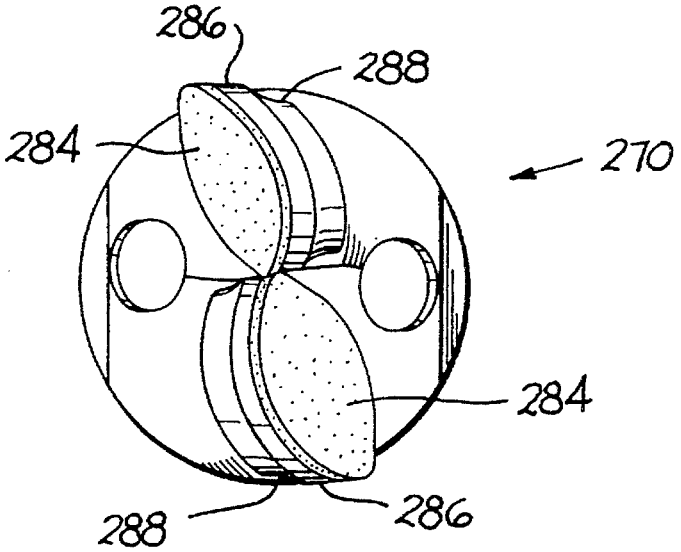
FIG. 15 is a top view of the specific embodiment of FIG. 14.

FIGS. 14 and 15 illustrate a seventh specific embodiment of the invention. The basic structure of this embodiment is shown and described in pending patent application Ser. No. 07/935,956, to Shierer et al , for a "Cutting Bit and Cutting insert," filed on Aug. 26, 1992. The difference between the cutting insert in the Rowlett et al. application and the present invention is the shape of the axially forwardly facing arcuate surface of each insert. The above pending application, which has already been incorporated by reference herein, discloses the structural details not discussed below.

Referring to FIGS. 14 and 15, the bit has a bit body 270 with an axially forward end 272 containing pockets 274 and 276. Each pocket 274, 276 receives a polycrystalline diamond cutting insert 278. Cutting insert 278 has opposite arcuate surfaces 280 and 282 wherein surface 280 faces axially forwardly. A layer of polycrystalline diamond material 284 covers the front face of the insert 278.

The axially forwardly facing arcuate surface 280 has a leading relief surface 286 and a trailing relief surface 288. The leading relief surface 286 includes the polycrystalline diamond layer. In a fashion like that shown for the first specific embodiment, the leading relief surface 286 is disposed at a relief angle of 5° and the trailing relief surface 288 is disposed at a relief angle of 22°. The broader range for the leading relief angle is between about 0° and about 8° with a narrower range of 2° to 6°. The broader range for the trailing relief angle is 10° to about 30° with the narrower range being between about 14° to about 26°.

In operation, the bit 270 has advantages like those for the first specific embodiment of the bit. The bit also provides those advantages associated with the use of the polycrystalline diamond insert. These advantages will not be repeated herein.

Having described the presently preferred specific embodiments of the present invention, it is understood that the invention may be otherwise embodied within the scope of the following claims.

What is claimed is:

1. A roof drill bit comprising:

a tool body having a cutting insert affixed thereto, said cutting insert having one face, an opposite face, and a side surface joining said one face and said opposite face;

said side surface having a leading side relief portion adjacent to the one face and a trailing side relief portion adjacent to the opposite face, said leading side relief portion being relieved at an angle so that the interior angle between the one face and the leading side relief portion is less than 90 degrees, said trailing side relief portion being relieved to a greater degree than said leading side relief portion; and said leading side relief portion extending from the one face a distance of between about one-third to about two-thirds the thickness of the cutting insert, and said trailing side relief portion extending from the opposite face a distance of between about one-third to about two-thirds the thickness of the cutting insert.

2. The roof drill bit of claim 1 wherein the leading side relief portion extends from the one face a distance of about one-half the thickness of the cutting insert.

3. The roof drill bit of claim 1 wherein the trailing side relief portion is relieved at an angle of between about 10 degrees to about 30 degrees.

4. The roof drill bit of claim 1 wherein the leading side relief portion is relieved at an angle of about 5 degrees, and the trailing side relief portion is relieved at an angle of about 22 degrees.

5. The roof drill bit of claim 1 wherein a layer of polycrystalline diamond covers one of said faces.

6. A roof drill bit comprising:

a tool body having a cutting insert affixed thereto, said cutting insert having one face, an opposite face, and a side surface joining said one face and said opposite face;

said side surface having a leading side relief portion adjacent to the one face and a trailing side relief portion adjacent to the opposite face, said trailing side relief portion being relieved to a greater degree than said leading side relief portion; and said leading side relief portion extending from the one face a distance of between about one-third to about two-thirds the thickness of the cutting insert, and said trailing side relief portion extending from the opposite face a distance of between about one-third to about two-thirds the thickness of the cutting insert, wherein the side surface further includes a mediate side relief portion between the leading side relief portion and the trailing side relief portion, and said mediate side relief portion being relieved at an angle that is greater than the angle of relief of the leading side relief portion and less than the angle of relief of the trailing side relief portion.

7. A cutting insert for a roof drill bit, the insert comprising:

one face, an opposite face, and a side surface joining said one face and said opposite face;

said side surface portion having a leading side relief portion adjacent to the one face and a trailing side relief portion adjacent to the opposite face, said leading side relief portion being relieved at an angle so that the interior angle between the one face and the leading side relief portion is less than 90 degrees, said trailing side relief portion having a relief angle that is greater than the relief angle of said leading side relief portion; and said leading side relief portion extending from the one face a distance of between about one-third to about two-thirds the thickness of the cutting insert, and said trailing side portion extending from the opposite face a distance of between about one-third to about two-thirds the thickness of the cutting insert.

8. The cutting insert of claim 7 wherein the relief angle of the trailing side relief portion is between about 10 degrees and about 30 degrees.

9. The cutting insert of claim 7 wherein a layer of polycrystalline diamond covers one of said faces.

10. A cutting insert for a roof drill bit, the insert comprising:

one face, an opposite face, and a side surface joining said one face and said opposite face;

said side surface portion having a leading side relief portion adjacent to the one face and a trailing side relief portion adjacent to the opposite face, said trailing side relief portion having a relief angle that is greater than the relief angle of said leading side relief portion; and said leading side relief portion extending from the one face a distance of between about one-third to about two-thirds the thickness of the cutting insert and said trailing side portion extending from the opposite face a distance of between about one-third to about two-thirds the thickness of the cutting insert, wherein the side surface further includes a mediate side relief portion between the leading side relief portion and the trailing side relief portion, and said mediate side relief portion being relieved at an angle that is greater than the relief of the leading side relief portion and less than the angle of relief of the trailing side relief portion.

11. An excavating tool comprising:

a tool body having a cutting insert affixed to the axially forward end thereof;

said cutting insert having one face, an opposite face, and a pair of side surfaces joining said faces;

each one of said side surface portions having a leading side relief portion and a trailing side relief portion, said leading side relief portion being relieved at an angle so that the interior angle between the one face and the leading side relief portion is less than 90 degrees, said trailing side relief portion having a relief angle greater than the relief angle of said leading side relief portion; and said leading side relief portion extending from the one face a distance of between about one-third to about two-thirds the thickness of the cutting insert, and said trailing side portion extending from the opposite face a distance of between about one-third to about two-thirds the thickness of the cutting insert.

12. The excavating tool of claim 11 wherein the leading side relief portion extends from the one face a distance of about one-half the thickness of the cutting insert.

13. The excavating tool of claim 4 wherein the leading side relief portion has a relief angle of about 5 degrees, and the trailing side relief portion has a relief angle of about 22 degrees.

14. An excavating tool comprising:

a tool body having a cutting insert affixed to the axially forward end thereof;

said cutting insert having one face, an opposite face, and a pair of side surfaces joining said faces;

each one of said side surface portions having a leading side relief portion and a trailing side relief portion, said trailing side relief portion having a relief angle greater than the relief angle of said leading side relief portion; and said leading side relief portion extending from the one face a distance of between about one-third to about two-thirds the thickness of the cutting insert, and said trailing side portion extending from the opposite face a distance of between about one-third to about two-thirds the thickness of the cutting insert wherein the side surface further includes a mediate relief portion between the leading side relief portion and the trailing side relief portion, and said mediate relief portion having a relief angle that is greater than the relief angle of the leading relief portion and less than the relief angle of the trailing relief portion.

15. A method of drilling a hole in earth strata comprising the steps of:

positioning a tool including a rotary drill bit having a cutting insert against the earth strata, the cutting insert having one face, an opposite face and a pair of side surfaces joining said faces; each one of said side surface portions having a leading side relief portion and a trailing side relief portion, said leading side relief portion being relieved at an angle so that the interior angle between the one face and the leading side relief portion is less than 90 degrees, said trailing side relief portion being relieved to a greater degree than said leading side relief portion; and said leading side relief portion extending from the one face a distance of between about one-third to about two-thirds the thickness of the cutting insert, and said trailing side portion extending from the opposite face a distance of between about one-third to about two-thirds the thickness of the cutting insert; and rotating the rotary drill bit at a speed between about 250 to 600 rpm and at a thrust of between about 100 to about 10,000 pounds for a time sufficient to drill the hole in the earth strata.

16. A cutting insert for a rotary drill bit, the insert comprising:

one face, an opposite face, and a pair of side surfaces joining said faces;

said one side surface portion having a leading side relief portion adjacent to the leading face portion and a trailing side relief portion adjacent to the trailing face portion, said leading side relief portion being relieved at an angle so that the interior angle between the one face and the leading side relief portion is less than 90 degrees, said trailing side relief portion having a relief angle that is greater than the relief angle of said leading side relief portion; and said leading side relief portion extending from the one face a distance of between about one-third to about two-thirds the thickness of the cutting insert, and said trailing side portion extending from the opposite face a distance of between about one-third to about two-thirds the thickness of the cutting insert.

17. The cutting insert of claim 16 wherein said other side surface portion is approximately perpendicular to said leading face portion.

18. The cutting insert of claim 16 wherein a layer of polycrystalline diamond covers said one face.

19. The cutting insert of claim 16 wherein said one side surface trailing side relief portion has an arcuate shape.

20. A roof drill bit comprising:

a tool body having a cutting insert affixed thereto, said cutting insert having one face, an opposite face, and a side surface joining said one face and said opposite face;

said side surface having a leading side relief portion adjacent to the one face and a trailing side relief portion adjacent to the opposite face, said trailing side relief portion being of an arcuate shape; and said leading side relief portion extending from the one face a distance of between about one-third to about two-thirds the thickness of the cutting insert, and said trailing side relief portion extending from the opposite face a distance of between about one-third to about two-thirds the thickness of the cutting insert.

21. The roof drill bit of claim 20 wherein the trailing relief portion is of a convex shape.

22. The roof drill bit of claim 20 wherein the trailing relief portion is of a concave shape.

23. A cutting insert for a roof drill bit, the insert comprising:

one face, an opposite face, and a side surface joining said one face and said opposite face;

said side surface portion having a leading side relief portion adjacent to the one face and a trailing side relief portion adjacent to the opposite face, said trailing side relief portion being of an arcuate shape; and said leading side relief portion extending from the one face a distance of between about one-third to about two-thirds the thickness of the cutting insert, and said trailing side portion extending from the opposite face a distance of between about one-third to about two-thirds the thickness of the cutting insert.

24. The cutting insert of claim 23 wherein the trailing relief portion is of a convex shape.

25. The cutting insert of claim 23 wherein the trailing relief portion is of a concave shape.

26. An excavating tool comprising:

a tool body having a cutting insert affixed to the axially forward end thereof;

said cutting insert having one face, an opposite face, and a pair of side surfaces joining said faces;

each one of said side surface portions having a leading side relief portion and a trailing side relief portion, said trailing side relief portion being of an arcuate shape; and said leading side relief portion extending from the one face a distance of between about one-third to about two-thirds the thickness of the cutting insert, and said trailing side portion extending from the opposite face a distance of between about one-third to about two-thirds the thickness of the cutting insert.

27. The excavating tool of claim 26 wherein the trailing relief portion is of a convex shape.

28. The excavating tool of claim 27 wherein said convex trailing relief portion is defined by a constant radius.

29. The excavating tool of claim 26 wherein the trailing relief portion is of a concave shape.

30. The excavating tool of claim 29 wherein the concave trailing relief portion is defined by a constant radius.

* * * * *